US010794651B2

(12) United States Patent
Crown et al.

(10) Patent No.: US 10,794,651 B2
(45) Date of Patent: Oct. 6, 2020

(54) DUAL CONNECTOR FIREARM SUPPRESSOR

(71) Applicant: Smith & Wesson Corp., Springfield, MA (US)

(72) Inventors: Alexander Crown, Middleton, ID (US); Nolan Blake Young, Boise, ID (US); Grey Oliver Beaudry, Boise, ID (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 15/927,597

(22) Filed: Mar. 21, 2018

(65) Prior Publication Data

US 2019/0293376 A1 Sep. 26, 2019

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34
USPC ..... 89/14.4; 181/223
See application file for complete search history.

(56) References Cited

U.S. PATENT DOCUMENTS

| | | | | |
|---|---|---|---|---|
| 4,920,854 | A * | 5/1990 | Scanlon | F41A 21/30 181/223 |
| 5,164,535 | A | 11/1992 | Leasure | |
| 7,987,944 | B1 | 8/2011 | Brittingham et al. | |
| 2011/0132683 | A1* | 6/2011 | Miller | F41A 21/30 181/223 |
| 2017/0205176 | A1* | 7/2017 | Whitson | F41A 21/325 |
| 2017/0321985 | A1* | 11/2017 | Bray | F41A 21/34 |

OTHER PUBLICATIONS

GEMTECH Aurora Suppressor, 2 pages, admitted prior art.

* cited by examiner

*Primary Examiner* — Bret Hayes
(74) *Attorney, Agent, or Firm* — Stinson LLP

(57) ABSTRACT

A firearm sound suppressor and associated methods. The suppressor can include first and second firearm connectors at opposite ends of the suppressor for connecting to firearm mounts of different types. The suppressor can include symmetrical baffling and/or symmetrical gas flow passaging such that sound reduction performance of the suppressor is generally the same notwithstanding whether the first or second firearm connectors is used to connect the suppressor to the firearm. A protector can be used to protect the firearm connector that is not connected to the firearm.

19 Claims, 9 Drawing Sheets

DUAL CONNECTOR FIREARM SUPPRESSOR

FIELD

The present disclosure generally relates to firearm accessories, and more particularly to firearm suppressors.

BACKGROUND

Various types of firearm suppressors are known. Suppressors are used to reduce sound emitted when a shot is fired by slowing movement of gas from the firearm. Conventional suppressors are designed to be connected to a firearm in one orientation in which an upstream end of the suppressor is connected to the firearm and a downstream end of the suppressor is opposite the upstream end.

SUMMARY

In one aspect, a firearm sound suppressor is configured for use with a firearm having a first type of suppressor connector or with a firearm having a second type of suppressor connector different than the first type. The firearm sound suppressor includes a housing having a first end and a second end opposite the first end. The suppressor includes a projectile passage extending between the first and second ends of the housing through which a projectile can pass along a projectile axis through the firearm suppressor. Gas baffling is located in the housing. A first firearm connector at the first end of the housing has a first construction configured to connect to the first type of suppressor connector. A second firearm connector at the second end of the housing has a second construction configured to connect to the second type of suppressor connector.

In another aspect, a firearm sound suppressor includes a housing having a first end and a second end opposite the first end. A projectile passage extends between the first and second ends of the housing through which a projectile can pass along a projectile axis through the firearm suppressor. Gas baffling is located in the housing. Gas flow passaging in the housing is at least partially defined by the gas baffling. The gas flow passaging includes a first portion and a second portion. The second portion is substantially symmetrical to the first portion by reflection of the second portion about a plane extending transverse to the projectile axis or by reflection of the second portion about the plane and rotation of at least a segment of the second portion about the projectile axis.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
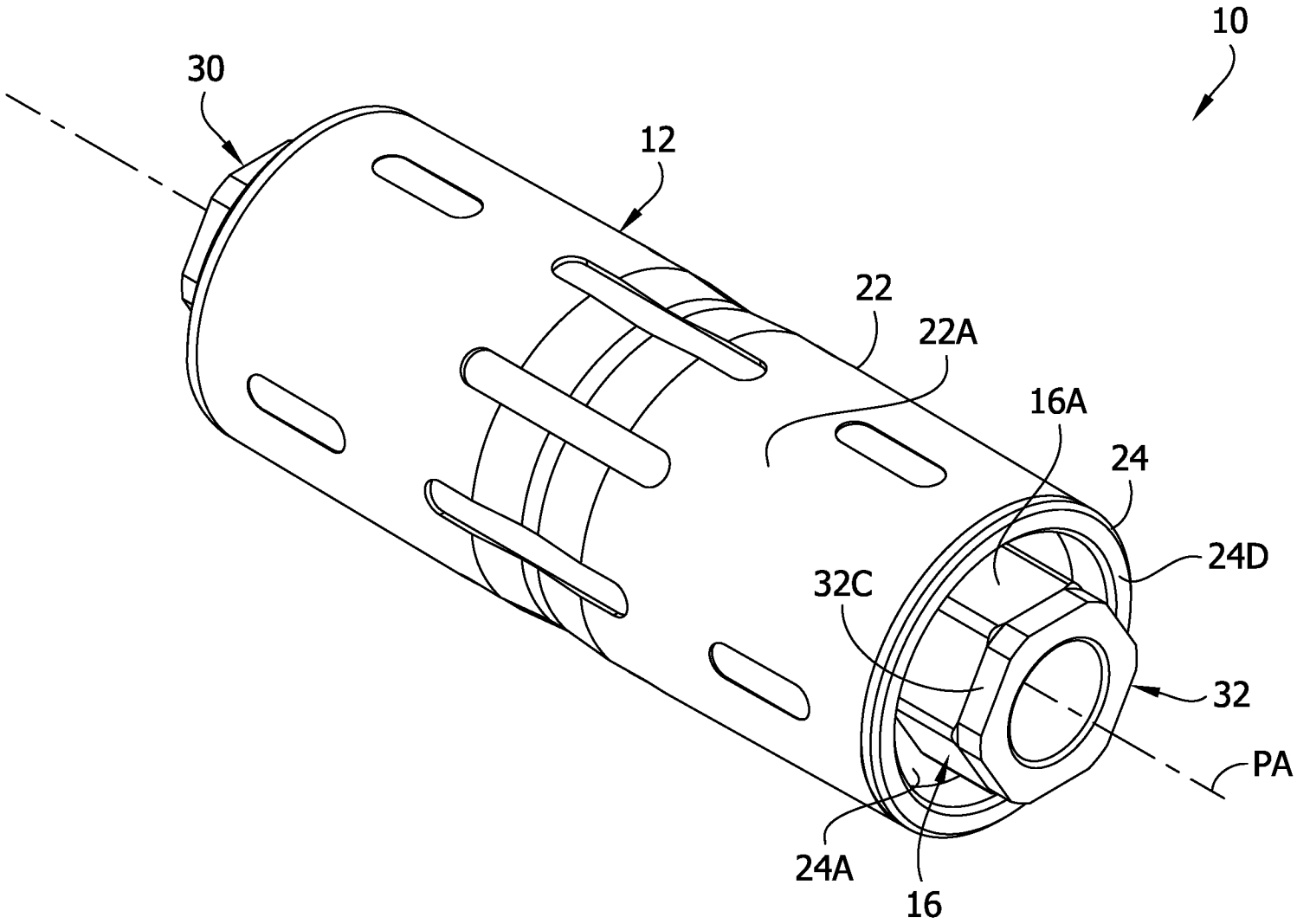
FIG. 1 is a front perspective of a firearm suppressor.
Figure 2:
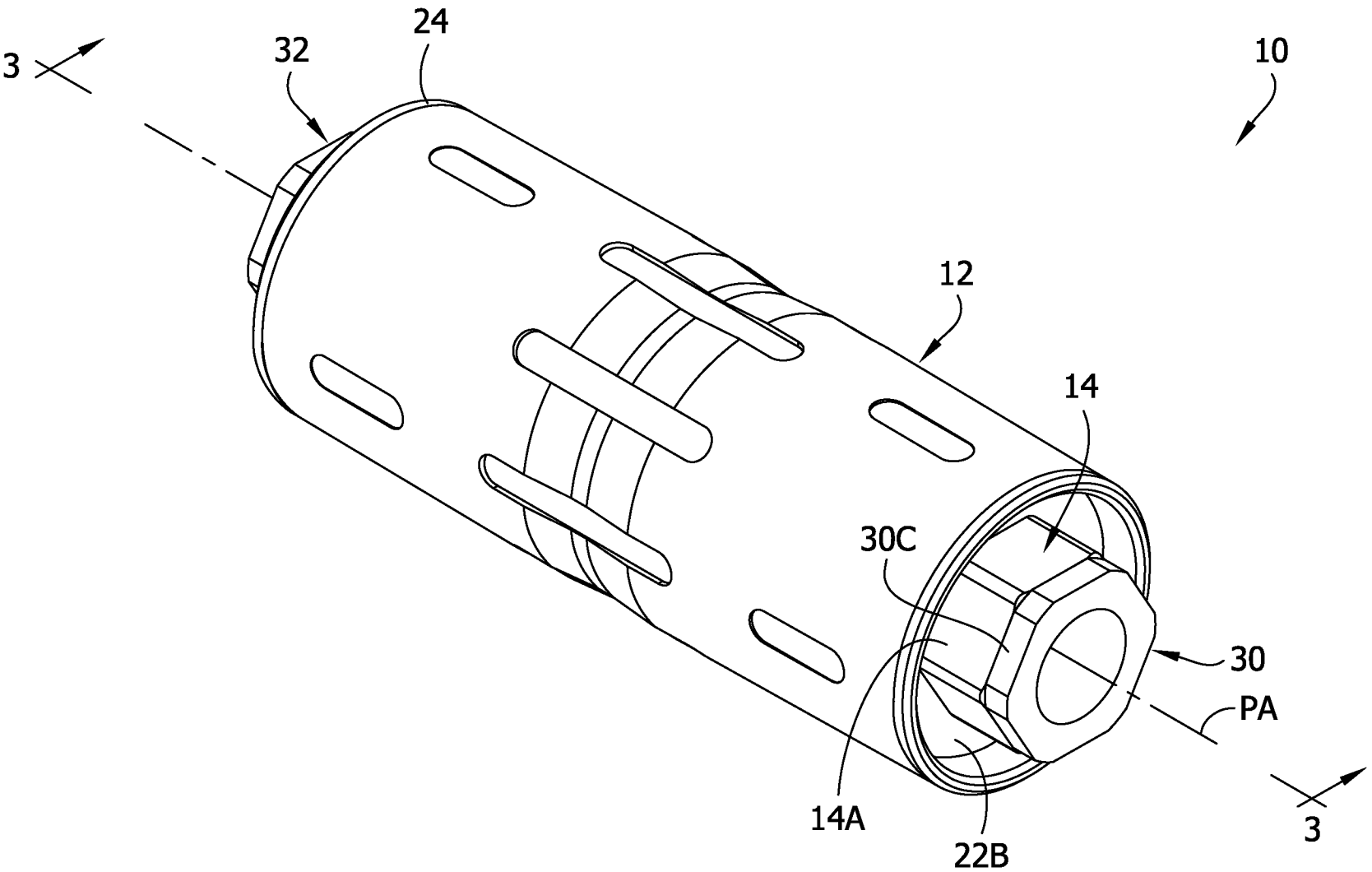
FIG. 2 is a rear perspective of the firearm suppressor.
Figure 3:
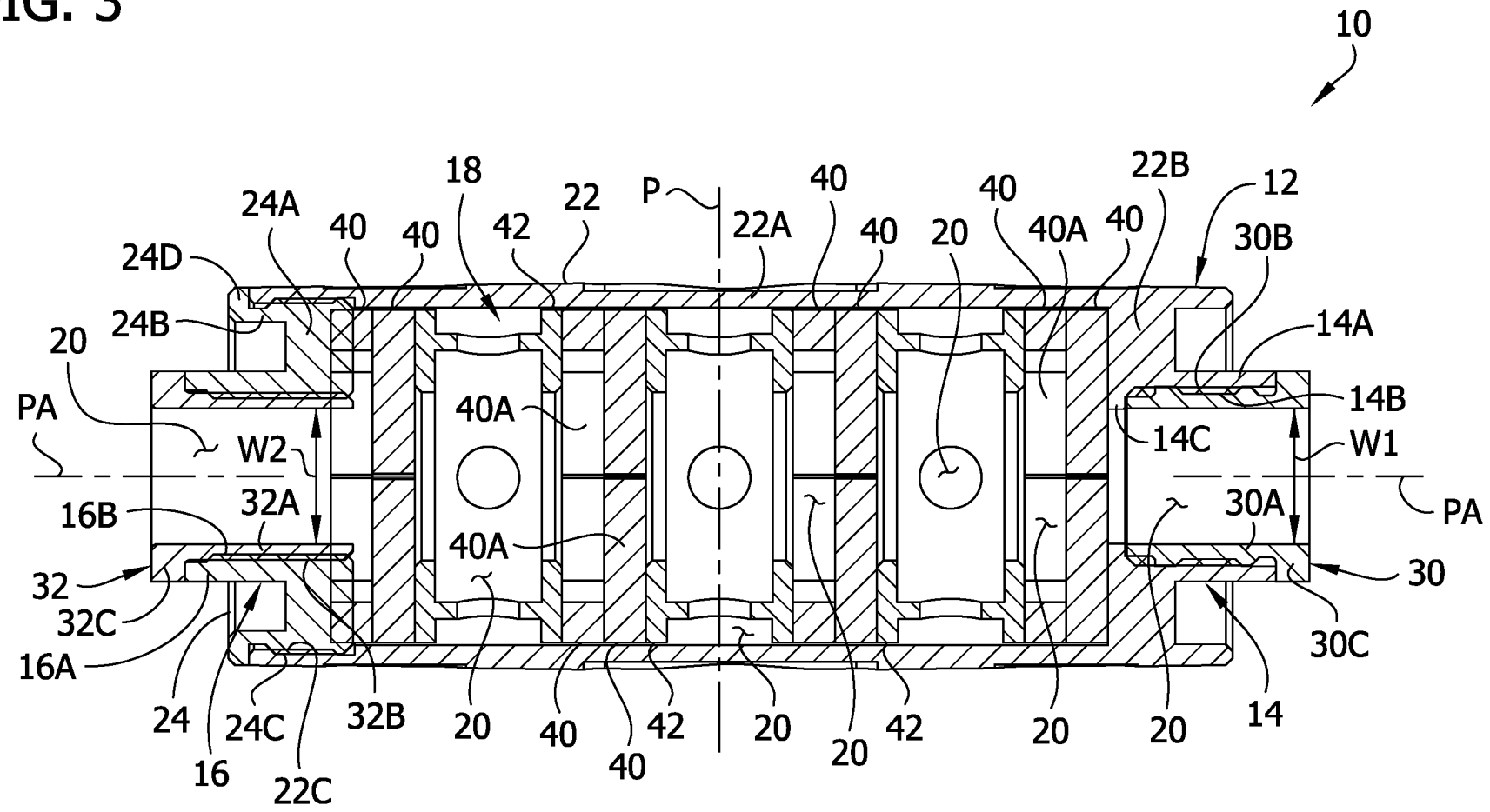
FIG. 3 is a section of the suppressor taken in a plane including line 3-3 of FIG. 2.

Referring to FIGS. 1-3, a firearm suppressor of the present disclosure is designated generally by the reference number 10. The suppressor is configured to be mounted on a firearm and defines a projectile axis PA or travel path along which a projectile (e.g., bullet) travels through the suppressor when fired from the firearm. The suppressor 10 is configured to reduce sound heard when the firearm is fired by reducing pressure and/or velocity of propellant gases from a muzzle of the firearm before the gases are emitted to the surrounding environment from the suppressor.

In general, the suppressor 10 includes a housing 12, first and second firearm connectors 14, 16 at opposite ends of the housing, gas baffling 18 in the housing, and gas flow passaging 20 in the housing at least partially defined by the baffling. As will be explained in further detail below, the suppressor 10 is mountable on a firearm using either of the firearm connectors 14, 16. The firearm connectors 14, 16 are configured to mount to different types of suppressor mounts on firearms such that the suppressor 10 is usable with different firearms by connecting the appropriate one of the firearm connectors to the firearm. The baffling 18 and gas flow passaging 20 is arranged to so that sound reduction performance achieved by the suppressor 10 is generally the same whether the first or second firearm connector 14, 16 is connected to the firearm.

The housing 12 includes a housing body 22 and an end cap 24. The housing body 22 includes a generally tubular portion 22A in which the baffling 18 is housed and an end wall 22B at a first end of the housing body. The housing body 22 includes a threaded opening 22C at a second end of the housing body opposite the end wall 22B. The end cap 24 is receivable in the threaded opening 22C to close the opening and maintain the baffling 18 in the housing. In FIG. 3, the baffling is shown overlapping with the end cap 24, but it will be understood that the end cap 24 compresses the baffling (i.e., the wipes 40 described below) in the actual suppressor such that no such overlap exists. The end cap 24 includes a circular wall 24A that forms an end wall of the housing 12 and includes a flange 24B extending from the circular wall. The end cap 24 has an external thread 24C for threaded connection with the threaded opening 22C of the housing body 22. For example, the threads 24C, 22C on the end cap 24 and housing body 22 can be corresponding right handed threads. The end cap 24 includes a shoulder 24D protruding radially outward around the flange 24B that seats against an end of the housing body 22 to positively locate the end cap with respect to the housing body 22. The housing 12 (and other components of the suppressor) can be made of aluminum or another suitable material. Housings having other configurations can be used without departing from the scope of the present invention.

The first firearm connector 14 is provided at the first end of the housing 12, and the second firearm connector 16 is provided at the second end of the housing. In the illustrated embodiment, the first and second firearm connectors 14, 16 are threaded connectors adapted to connect to a firearm by threading onto a threaded end of the firearm barrel (broadly, "suppressor connector"). In FIGS. 1-3, protective inserts 30, 32, described in further detail below, are shown installed in the firearm connectors 14, 16. A protective insert 30, 32 is removed from a firearm connector 14, 16 if it is desired to use that connector to connect the suppressor 10 to a firearm.

The first firearm connector 14 is integrally formed with the end wall 22B of the housing body 22. The first firearm connector 14 includes a sleeve 14A protruding from the end wall 22B of the housing body 22. The sleeve 14A has an opening and threads 14B in the opening for making a threaded connection with a suppressor connector of a firearm. The sleeve 14A of the first firearm connector includes "wrench flats" providing the first firearm connector 14 with an outer hexagonal shape for engagement by a wrench in installing or uninstalling the suppressor 10 on a firearm. The first firearm connector 14 includes a circumferential shoulder 14C protruding toward the projectile axis PA. When the first firearm connector 14 is threaded on a suppressor connector of a firearm, the suppressor connector (e.g., muzzle of the barrel) may abut the shoulder 14C to locate the suppressor 10 with respect to the suppressor connector.

The second firearm connector 16 is integrally formed with the end cap 24 of the housing 12. The second firearm connector 16 includes a sleeve 16A protruding from the circular wall 24A of the end cap 24. The sleeve 16A has an opening and threads 16B in the opening for making a threaded connection with a suppressor connector of a firearm. The sleeve 16A of the first firearm connector includes "wrench flats" providing the first firearm connector 16 with an outer hexagonal shape for engagement by a wrench in installing or uninstalling the suppressor 10 on a firearm. The second firearm connector 16 lacks a shoulder such as the shoulder 14C of the first firearm connector 14. When the second firearm connector 16 is threaded on a suppressor connector of a firearm, the suppressor connector may abut the free end of the sleeve 16A to locate the suppressor 10 with respect to the suppressor connector.

In one example, the thread 14B of the first firearm connector 14 is of a first thread type and the thread 16B of the second firearm connector 16 is of a second thread type. Thus, the first and second firearm connectors 14, 16 are configured to make a threaded connection with suppressor connectors having different thread types. If it is desired to mount the suppressor 10 on a firearm having a first thread type suppressor connector, the insert 30 is unscrewed and the first firearm connector 14 is threaded onto the suppressor connector. If it is desired to mount the suppressor 10 on a firearm having a second thread type suppressor connector, the insert 32 is removed and the second firearm connector 16 is threaded onto the suppressor connector. For example, the thread type of the first firearm connector 14 can be 13.5 mm×1 LH, and the thread type of the second firearm connector 16 can be ½"×28 RH.

Other types of firearm connectors can be used without departing from the scope of the present invention. Other thread types can be used. Moreover, connectors other than threaded connectors (e.g., lug and/or lug retainer, etc.) can be used for connecting to suppressor connectors of different constructions.

Figure 8:
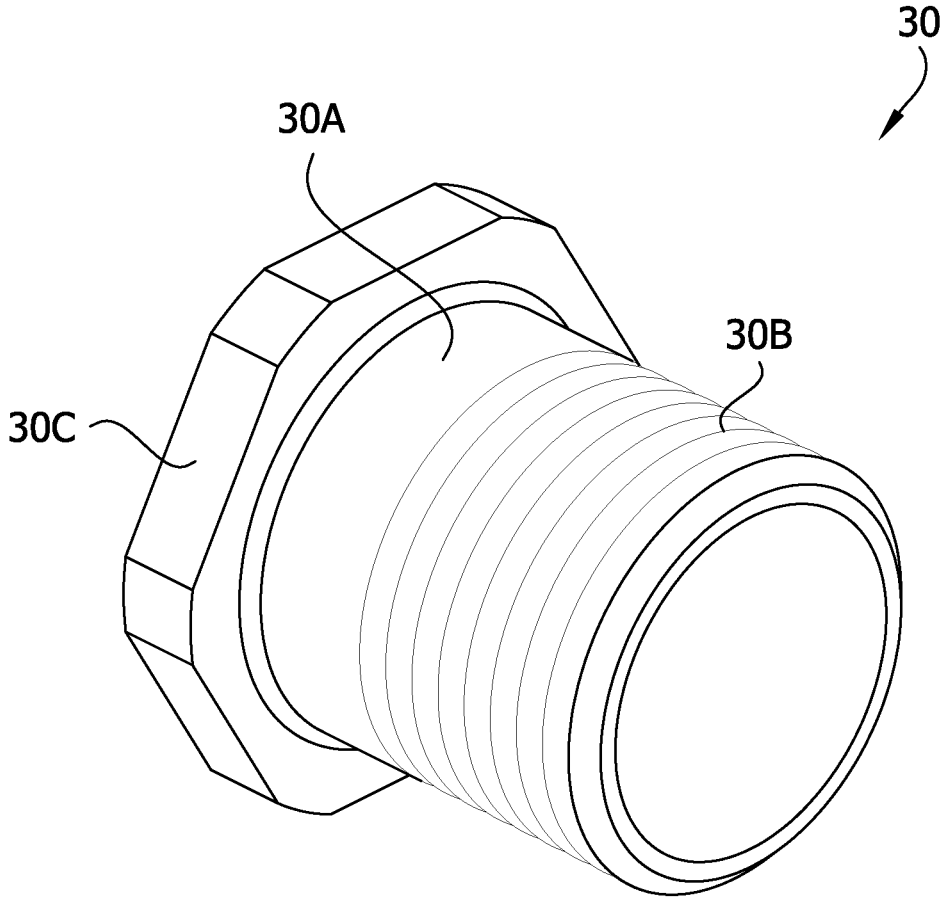
FIG. 8 is a perspective of a first thread protector of the firearm suppressor.

Referring to FIGS. 3 and 8, the first protective insert 30 (e.g., "thread protector") includes a tube 30A having an external thread 30B and a circumferential flange 30C at one end. The thread 30B corresponds to the thread 14B on the first firearm connector 14 for threaded connection of the protective insert 30 and the first firearm connector. The first protective insert 30 prevents the thread 14B from becoming fouled with blast effluents. A projectile passage extends through the first protective insert 30. The passage has a width W1 extending transverse to the projectile axis PA sized to permit passage of a projectile. The flange 30C has "wrench flats" providing the flange with an outer hexagonal shape for engagement by a wrench for installing and uninstalling the protective insert 30 in the first firearm connector 14.

Figure 9:
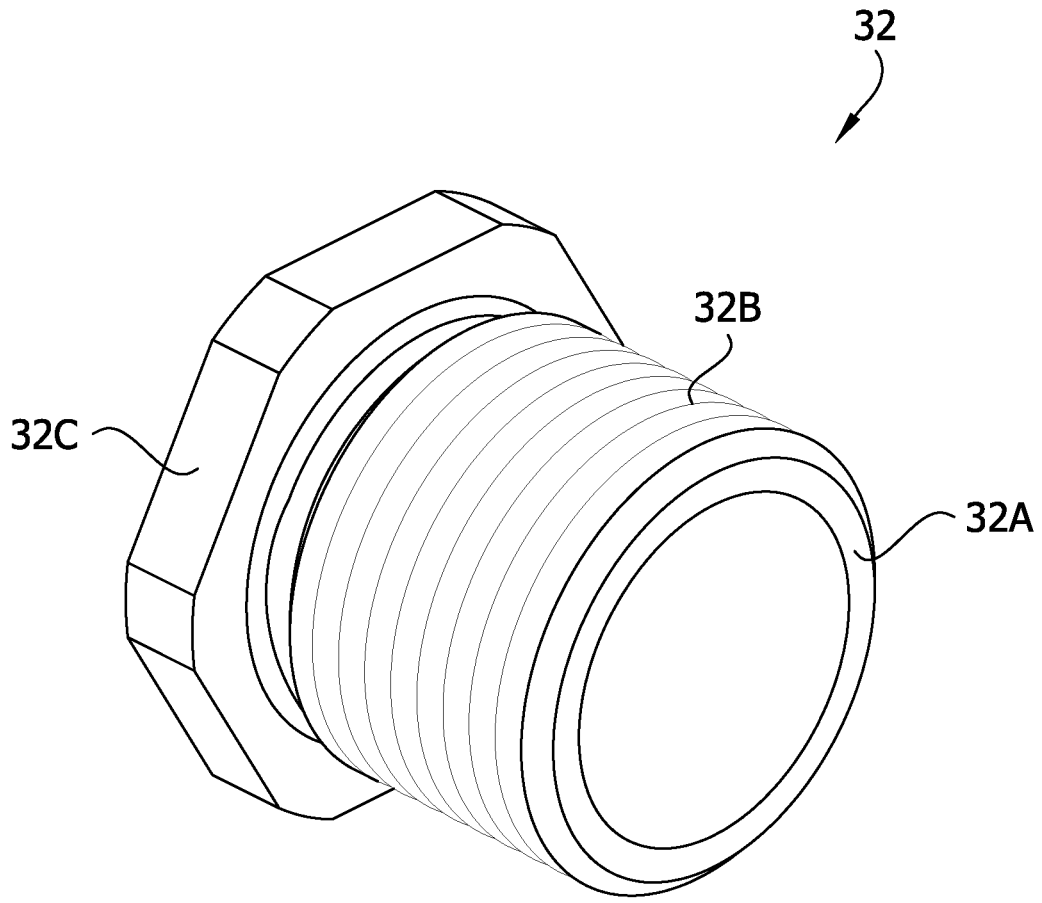
FIG. 9 is a perspective of a second thread protector of the firearm suppressor.

Referring to FIGS. 3 and 9, the second protective insert 32 (e.g., "thread protector") includes a tube 32A having an external thread 32B and a circumferential flange 32C at one end. The thread 32B corresponds to the thread 16B on the second firearm connector 16 for threaded connection of the protective insert 32 and the second firearm connector. The second protective insert 32 prevents the thread 16B from becoming fouled with blast effluents. A projectile passage extends through the second protective insert 32. The passage has a width W2 extending transverse to the projectile axis PA sized to permit passage of a projectile. Desirably, the width W2 is the same as the width W1 of the passage of the first insert 14, for gas flow or sound reduction reasons explained below. The flange 32C has "wrench flats" providing the flange with an outer hexagonal shape for engagement by a wrench for installing and uninstalling the protective insert 32 in the first firearm connector 16.

Thread protectors having other configurations can be used, and the thread protectors can be omitted, without departing from the scope of the present invention.

Figure 4:
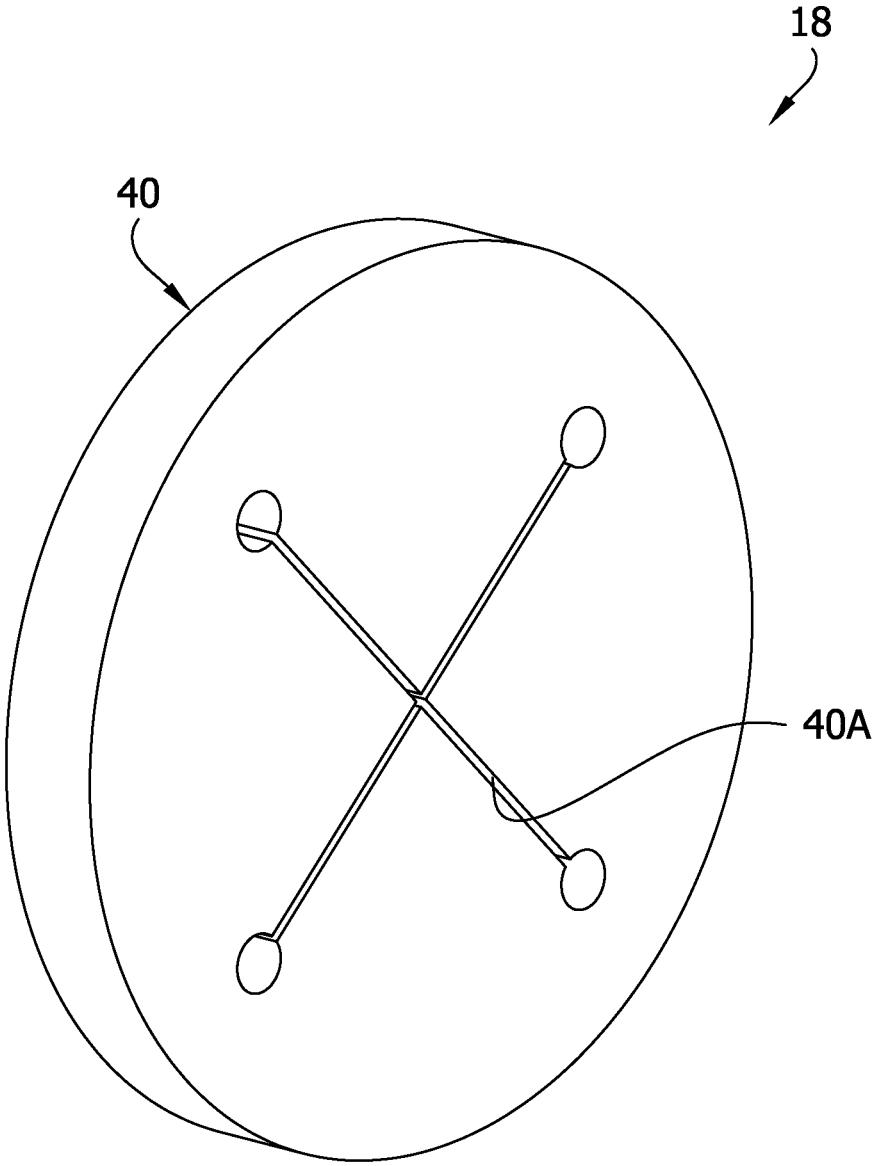
FIG. 4 is a perspective of a first type of baffle of the firearm suppressor.
Figure 5:
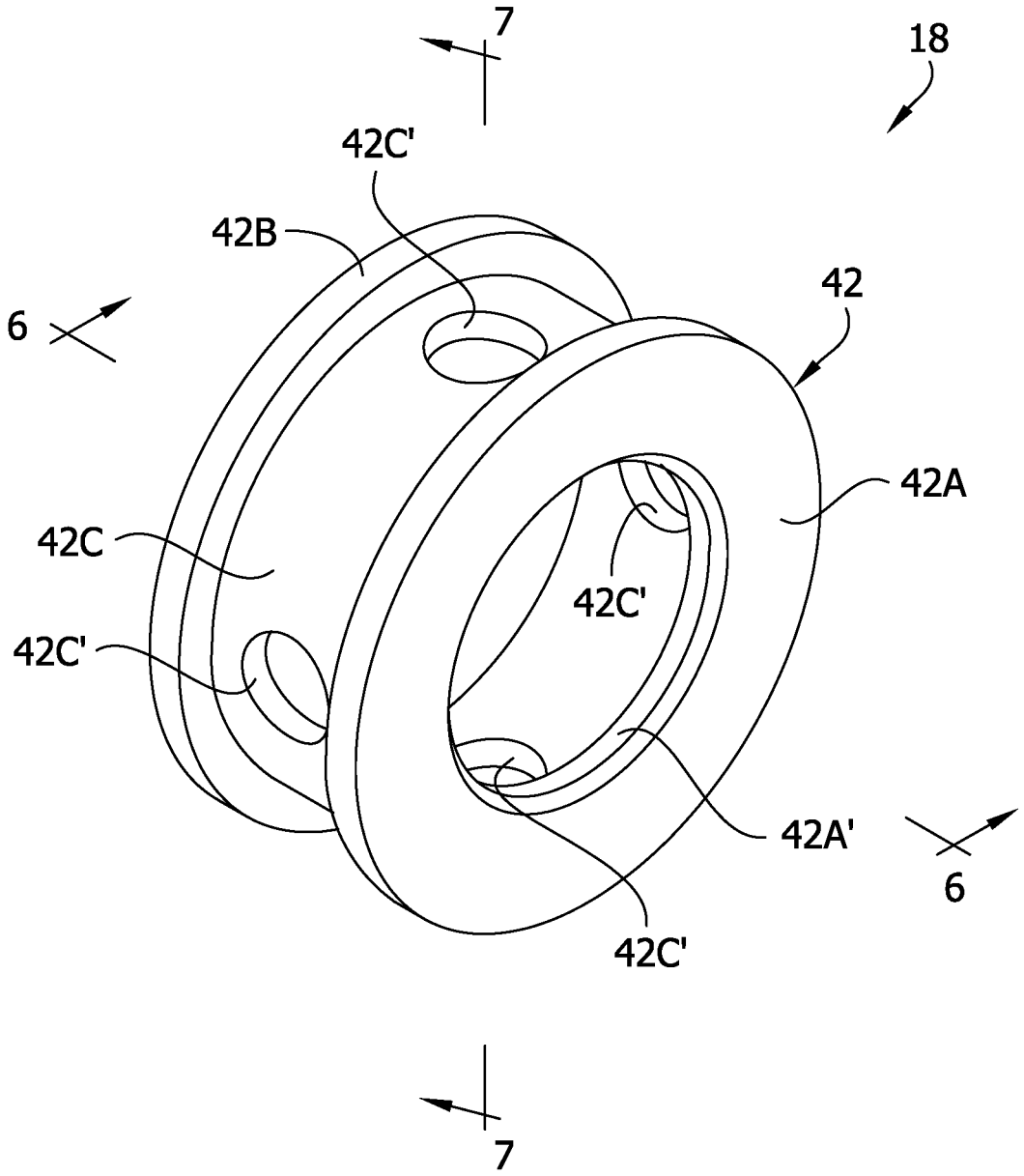
FIG. 5 is a perspective of a second type of baffle of the firearm suppressor.
Figure 6:
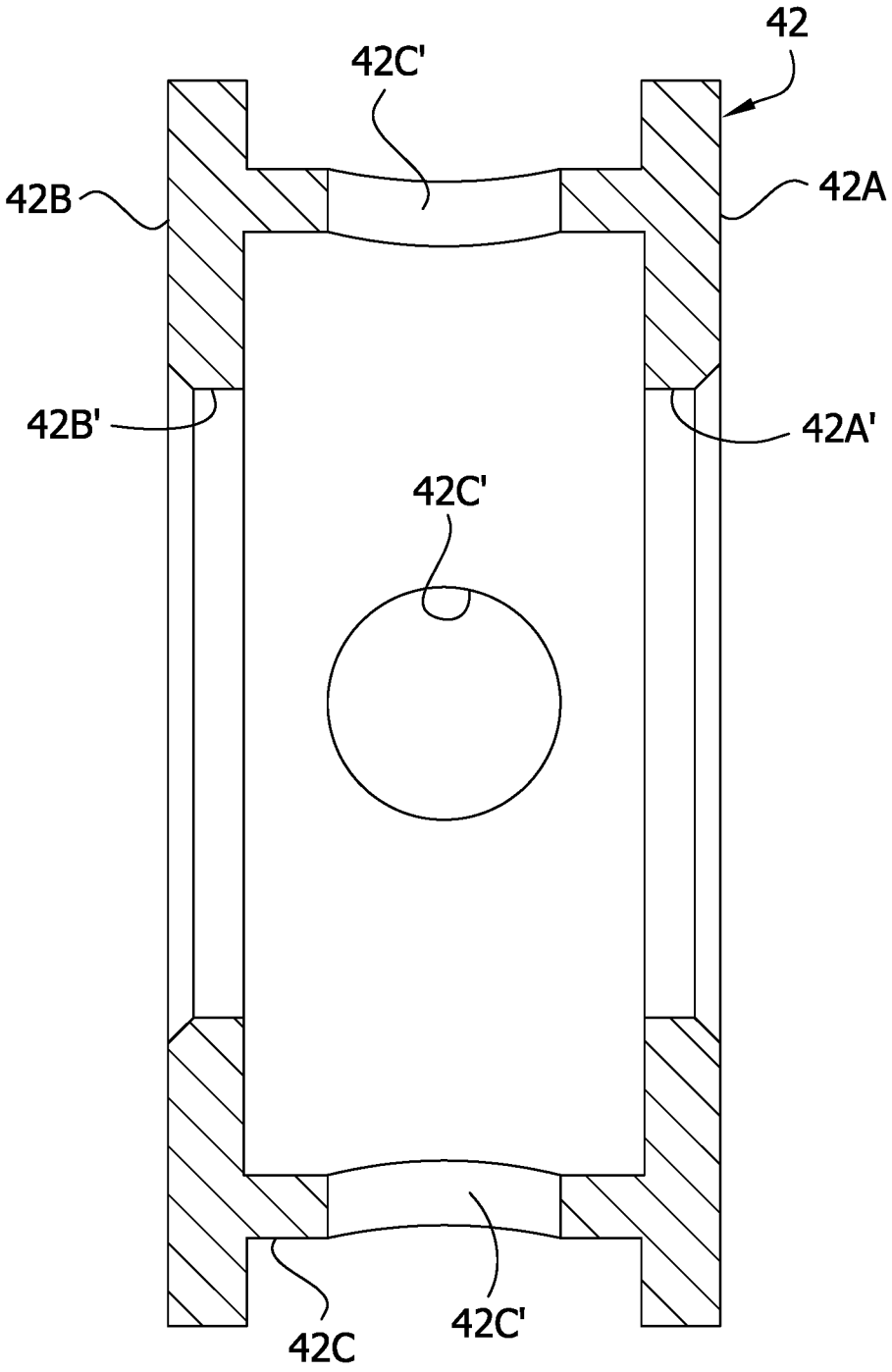
FIG. 6 is a section of the second type of baffle taken in a plane including line 6-6 of FIG. 5.
Figure 7:
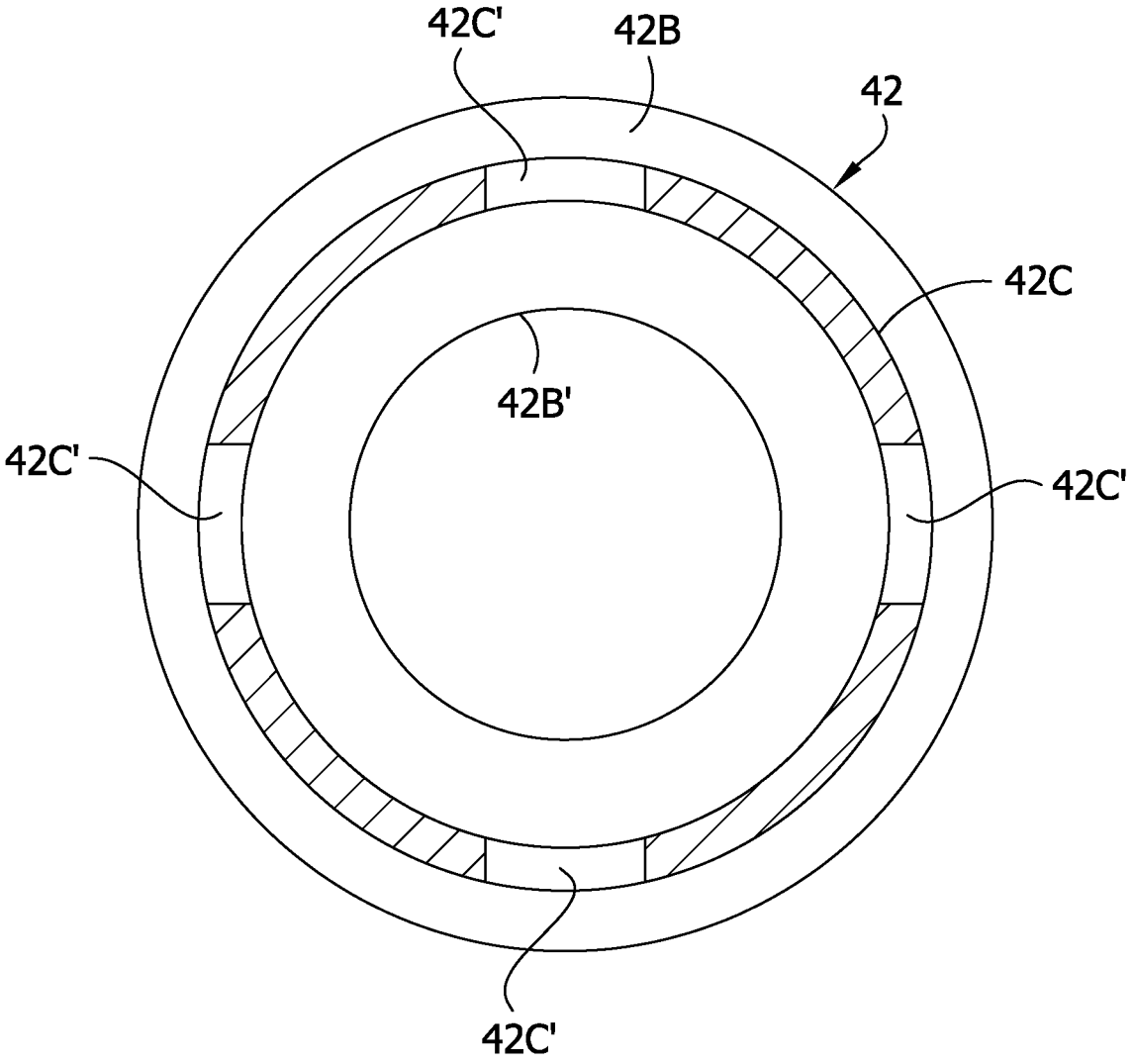
FIG. 7 is a section of the second type of baffle taken in a plane including line 7-7 of FIG. 5.

In the illustrated embodiment, the gas baffling 18 includes two types of baffles. A first type of baffle 40, shown in closer detail in FIG. 4, can be referred to as a "wipe." A second type of baffle 42, shown in closer detail in FIGS. 5-7, can be referred to as a "spacer" for spacing the wipes. As shown in FIG. 3, multiple of these first and second types of baffles 40, 42, are arranged in a sequence of two baffles 40 of the first type, one baffle 42 of the second type, and so on. In the sequence of baffles, a first baffle 40 of the first type is closest to the connector 14, and a second baffle 40 of the first type is closest to the connector 16. Other types of baffles, and other arrangements of baffles can be used without departing from the scope of the present invention.

The first type of baffle or "wipe" 40 has a disc-like body and includes a cross-shaped opening 40A. The wipe 40 can be made of polyurethane (e.g., having a durometer of about 85 Shore A) or another suitable type of material. In the assembled suppressor, desirably the cross-shaped openings of adjacent wipes 40 are radially offset by about 45 degrees with respect to each other such that the cross-shaped openings are not in alignment. However, other orientations can be used. The wipes 40 are constructed to permit a projectile traveling along the projectile axis PA to pass the wipes 40 through their cross-shaped openings 40A. The projectile forces the cross-shaped openings 40A to open sufficiently for the projectile to pass. Propellant gasses behind the projectile are also able to pass through the deformed cross-shaped openings 40A, but the wipes 40 baffle the propellant gases as they pass through the wipes. After the temporary deformation of the wipes 40 due to the projectile and gasses passing the wipes, the wipes desirably substantially resume their original configuration. The wipes 40 will eventually become damaged and may have a useable lifespan of between 20-30 shots.

The second type of baffle 42 includes a baffle body having a first circular end wall 42A, a second circular end wall 42B, and an intermediate tubular bridge structure 42C extending between and connecting the end walls. In the illustrated embodiment, the bridge structure 42C is tubular and has a smaller outer diameter than the end walls 42A, 42B. The baffle 42 has a cylindrical interior defined by the end walls 42A, 42B and the bridge structure 42C. The end walls 42A, 42B have circular openings 42A', 42B' of the same size through which a projectile enters and exits the baffle. The end walls 42A, 42B have flanges extending radially away from the projectile axis PA outboard of the bridge structure 42C to define an annular space between the end walls. The bridge structure 42C has circular openings 42C' to permit gas to travel radially from the interior of the baffle to the annular space. The annular space can be empty or can be filled with a filler material such as foam, etc.

Other types of baffling can be used without departing from the scope of the present invention. For example, the wipes can be omitted, and a series of hollow baffles having a hollow interior can be used. Moreover, the baffles may be formed as part of a "monocore" or other similar structure and need not be formed separately from the housing.

In the illustrated embodiment, the housing 12, baffling 18, and one of the inserts 30, 32 combine to define the gas flow passaging 20 through the suppressor 10. In general, the gas flow passaging 20 is bounded by one of the inserts 30, 32 (only one being installed when on a firearm), the baffles 40, and the baffles 42. The gas flow passaging 20 is bounded by the housing 12 at the outer circumference of the annular spaces of the baffles 42. The gas flow passaging 20 is designed to reduce the velocity and pressure of gas in the suppressor 10 before the gas is emitted to the environment outside the suppressor.

In an aspect of the present disclosure, the gas flow passaging 20 is desirably arranged to produce substantially the same gas flow profile through the gas flow passaging notwithstanding whether the first firearm connector 14 or the second firearm connector 16 is connected to the firearm. The similarity of the gas flow profile from either end of the suppressor 10 results in the suppressor providing essentially the same sound reduction (assuming the same firearm and type of ammunition cartridge) from either end of the suppressor 10. The similarity in gas flow and sound reduction in both directions through the suppressor is accomplished by symmetry in the gas flow passaging 20.

In a first aspect of symmetry, each baffle 40, 42 itself, and the three-dimensional gas flow passaging defined by the baffle, has reflective symmetry about a plane bisecting the baffle and extending transverse to the projectile axis PA. For example, consider the symmetry of the center baffle 42 with respect to plane P shown in FIG. 3. The openings 42A', 42B' in the end walls 42A, 42B are the same shape and size and are equidistant from the plane P. The bridge structure 42C has reflective symmetry about the plane P. The openings 42C' in the bridge structure have reflective symmetry about the plane P. The symmetry of the baffle 42 itself leads to symmetry of the portion of the gas flow passaging 20 defined by the baffle. For example, the gas flow passaging 20 inside the baffle 42 on opposite sides of the plane P is symmetrical. However, the structure of the baffle does not necessarily need to be symmetrical for there to be symmetrical gas flow passaging.

In another aspect of symmetry, the gas flow passaging 20 has substantial overall symmetry. The gas flow passaging 20 from and including the wipe 40 closest to the left end of the housing 12 to and including the wipe 40 closest to the right end of the housing can be referred to as the "baffled gas flow passaging." In the illustrated embodiment, the baffled gas flow passaging is substantially symmetrical about a plane P bisecting the baffled gas flow passaging. For example, referring to FIG. 3, the three-dimensional portion of the gas flow passaging 20 inside the left-most baffle 42 is symmetrical to the three-dimensional portion of the gas flow passaging inside the right-most baffle 42 about the plane P. Moreover, in the illustrated embodiment, the baffled gas flow passaging extending from the plane P to and including the left-most wipe 40 (the left half of the baffled gas flow passaging) is symmetrical with the gas flow passaging 20 extending from the plane P to the right-most wipe 40 (the right half of the baffled gas flow passaging). Desirably, a majority (i.e., more than 50%) of the left half of the baffled gas flow passaging is symmetrical to a majority (i.e., more than 50%) of the right half of the baffled gas flow passaging. More desirably, at least 60% of the left half of the baffled gas flow passaging is symmetrical to at least 60% of the right half of the baffled gas flow passaging. Even more desirably, at least 75% of the left half of the baffled gas flow passaging is symmetrical to at least 75% of the right half of the baffled gas flow passaging. Even more desirably, at least 85% of the left half of the baffled gas flow passaging is symmetrical to at least 85% of the right half of the baffled gas flow passaging. In the illustrated embodiment, substantially all of the left half of the baffled gas flow passaging is symmetrical to substantially all of the right half of the baffled gas flow passaging. The percentages referred to herein with respect to the left and right halves of the baffled gas flow passaging are determined by comparison of a single three-dimensional region of the respective half to the three-dimensional totality of the respective half, or by comparison of a collection of multiple spaced three-dimensional regions of the respective half to the three-dimensional totality of the respective half. In other words, the percentages are determined by comparison of a single volumetric region of the half to the volume of the half as a whole, or by comparison of a collection of spaced volumetric regions of the half to the volume of the half as a whole. Thus, the symmetry can be with respect to a single region of the left half compared to a single region of the right half, or can be with respect to multiple spaced regions of the left half compared to multiple spaced regions of the right half.

Unless otherwise specified, the term "symmetry" as used herein means reflective symmetry (e.g., reflection about the plane P) or rotoreflection symmetry (e.g., reflection about the plane P and rotation of at least a segment about the projectile axis PA). For example, in the illustrated embodiment, the gas flow passaging 20 defined by the left-most baffle 42 has reflective symmetry about the plane P with the gas flow passaging defined by the right-most baffle 42. Moreover, the left and right portions of the gas flow passaging 20 defined by the center baffle 42 have reflective symmetry about the plane P. On the other hand, the wipe 40 immediately to the left of the center baffle 42 has rotoreflective symmetry with the wipe 40 immediately to the right of the center baffle. The rotoreflective symmetry is shown by reflection of the left wipe 40 about the plane P and rotation of that reflection 45 degrees about the projectile axis (to orient the respective cross-shaped openings 40A in registration with each other). When viewing the baffled gas flow passaging as a whole, the half left of the plane P has rotoreflective symmetry with the half right of the plane P as shown by reflection of the left half about the plane P and 45 degree rotation of passaging segments defined by the cross-shaped openings 40A of the wipes 40 about the projectile axis PA. It will be understood that other types of segments of the gas flow passaging can be shown to have rotoreflection symmetry by reflection and rotation without departing from the scope of the present invention. A volumetric portion of the gas flow passaging 20 to the left of the plane P can have rotoreflection symmetry with a corresponding volumetric portion of the gas flow passaging to the right of the plane by reflection of the left portion about the plane and rotation of at least some of the left portion about the projectile axis PA.

In view of the above, it will be appreciated that no matter whether the suppressor 10 is connected to a firearm at the first or second firearm connector 14, 16, the gas flow passaging 20 provides essentially the same gas flow pattern extending distally from the firearm to not only provide effective sound suppression but also achieve nearly the same level of sound suppression. It has been found that the exit passage of the suppressor 10 affects the sound suppression performance. The inserts 30, 32 being configured to provide essentially the same exit passage of the suppressor no matter which one of the inserts defines the exit passage assists in providing the suppressor with the same sound suppression performance no matter whether the first or second firearm connector 14 is connected to the firearm (i.e., no matter whether the first or second insert defines the exit passage).

In a method of using the suppressor 10, the user selects which of the firearm connectors 14, 16 is appropriate for connecting the firearm of choice and removes the insert 30, 32 in the selected connector. The user then threads the selected firearm connector 14, 16 onto the threaded suppressor connector on the barrel of the firearm. When the user fires the firearm, the projectile travels along the projectile axis PA through the suppressor 10. Propellant gases also travel through the suppressor along the tortuous gas flow passaging 20. The gas exits the suppressor 10 through the remaining insert 30, 32 at lower velocity and with less pressure than when the gas entered the suppressor.

Desirably, the threading of the second firearm connector 16 and housing end cap 24 are the same hand (e.g., right handed) so the end cap tends to tighten in the threaded opening 22C of the housing body 22 rather than loosen as the user applies torque to the housing body to tighten the second firearm connector 16 onto the suppressor connector.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm sound suppressor for use with a firearm, the firearm sound suppressor comprising:

a housing having a first end and a second end opposite the first end;

a projectile passage extending between the first and second ends of the housing through which a projectile can pass along a projectile axis through the firearm suppressor;

gas baffling in the housing defining an entirety of gas baffling in the housing; and gas flow passaging in the housing at least partially defined by the gas baffling, the gas flow passaging including a first portion and a second portion, the second portion being substantially symmetrical to the first portion by reflection of the second portion about a plane extending transverse to the projectile axis or by reflection of the second portion about the plane and rotation of at least a segment of the second portion about the projectile axis;

wherein the gas flow passaging is arranged to produce substantially the same gas flow profile of gas flowing away from the firearm through the gas flow passaging notwithstanding whether the first end of the housing or the second end of the housing is closer to the firearm when the firearm sound suppressor is connected to the firearm and the firearm is fired;

wherein the gas baffling includes a first baffle of the entirety of gas baffling in the housing closest to the first end of the housing and a second baffle of the entirety of gas baffling in the housing closest to the second end of the housing, and the gas flow passaging being at least partially defined by the first and second baffles.

2. A firearm sound suppressor as set forth in claim 1, wherein the gas flow passaging has a first half toward the first end of the housing and the gas flow passaging has a second half toward the second end of the housing, and wherein said first portion is a majority of the first half of the gas flow passaging and said second portion is a majority of the second half of the gas flow passaging.

3. A firearm sound suppressor as set forth in claim 1, wherein the gas baffling includes a baffle at least partially defining the first and second portions of the gas flow passaging.

4. A firearm sound suppressor as set forth in claim 3, wherein the baffle has an interior at least partially defining the first and second portions of the gas flow passaging.

5. A firearm sound suppressor as set forth in claim 3, wherein the baffle includes a baffle body including a first end wall and a second end wall spaced from the first end wall along the projectile axis, the baffle body including a bridge structure bridging a space between and connecting the first and second end walls, the bridge structure having an internal surface at least partially defining the gas flow passaging.

6. A firearm sound suppressor as set forth in claim 5, wherein the first and second end walls define respective flanges extending radially away from the projectile axis outboard of the bridge structure, the bridge structure including at least one opening to permit gas to travel to a space between the flanges of the first and second end walls.

7. A firearm sound suppressor as set forth in claim 1, wherein the gas baffling includes first and second baffles, the first baffle at least partially defining the first portion of the gas flow passaging, and the second baffle at least partially defining the second portion of the gas flow passaging.

8. A firearm sound suppressor as set forth in claim 7, wherein the first and second baffles have respective interiors, the interior of the first baffle at least partially defining the first portion of the gas flow passaging, the interior of the second baffle at least partially defining the second portion of the gas flow passaging.

9. A firearm sound suppressor as set forth in claim 1, wherein the first portion of the gas flow passaging is a first half of the gas flow passaging, and the second portion of the gas flow passaging is a second half of the gas flow passaging.

10. A firearm sound suppressor as set forth in claim 1, wherein the second portion is substantially symmetrical to the first portion by reflection of the second portion about the plane and rotation of at least a segment of the second portion about the projectile axis.

11. A firearm sound suppressor as set forth in claim 1, further comprising a first firearm connector at the first end of the housing and a second firearm connector at the second end of the housing such that the firearm sound suppressor is selectively mountable using the first firearm connector or the second firearm connector.

12. A firearm sound suppressor as set forth in claim 1, wherein the gas flow passaging defines an entirety of gas flow passaging in the housing configured to receive gas from the firearm, the entirety of the gas flow passaging in the housing arranged to produce substantially the same gas flow profile through the gas flow passaging notwithstanding whether the first end of the housing or the second end of the housing is closer to the firearm when the firearm sound suppressor is connected to the firearm and the firearm is fired.

13. A firearm sound suppressor for use with a firearm, the firearm sound suppressor comprising:

a housing having a first end and a second end opposite the first end;

a projectile passage extending between the first and second ends of the housing through which a projectile can pass along a projectile axis through the firearm suppressor;

gas baffling in the housing; and gas flow passaging in the housing at least partially defined by the gas baffling, the gas flow passaging including a first portion and a second portion, the second portion being substantially symmetrical to the first portion by reflection of the second portion about a plane extending transverse to the projectile axis or by reflection of the second portion about the plane and rotation of at least a segment of the second portion about the projectile axis;

further comprising a first firearm connector at the first end of the housing and a second firearm connector at the second end of the housing.

14. A firearm sound suppressor as set forth in claim 13, wherein the first firearm connector is a threaded connector and includes a thread of a first thread type.

15. A firearm sound suppressor as set forth in claim 14, wherein the second firearm connector is a threaded connector and includes a thread of a second thread type.

16. A firearm sound suppressor as set forth in claim 15, wherein the first thread type is 13.5×1 and the second thread type is ½×28.

17. A firearm sound suppressor as set forth in claim 14, wherein the thread of the first firearm connector is an internal thread, and the firearm sound suppressor further includes a thread protector, the thread protector including an external thread threadable onto the internal thread of the first firearm connector, the thread protector having an opening through which a projectile can pass along the projectile axis when the thread protector is threaded on the first firearm connector.

18. A firearm sound suppressor as set forth in claim 17, wherein the thread protector is a first thread protector and the firearm sound suppressor comprises a second thread protector, the thread of the second firearm connector is an internal thread, the second thread protector including an external thread threadable onto the internal thread of the second firearm connector, the thread protector having an opening through which a projectile can pass along the projectile axis when the thread protector is threaded on the second firearm connector.

19. A firearm sound suppressor as set forth in claim 13, further comprising a first protective insert and a second protective insert, the first protective insert being configured for reception in the first firearm connector for protecting the first firearm connector, and the second protective insert being configured for reception in the second firearm connector for protecting the second firearm connector, the first and second protective inserts having respective openings through which a projectile can pass when the protective inserts are received in the respective first and second firearm connectors, said openings having substantially the same width extending transverse to the projectile axis when the protective inserts are received in the respective first and second firearm connectors.

* * * * *